United States Patent [19]

Iaboni

[11] 4,163,302

[45] Aug. 7, 1979

[54] WALL CLEANING APPARATUS

[76] Inventor: Vincent Iaboni, 8469 Albanel, Montreal, Quebec, Canada, H1P 2K9

[21] Appl. No.: 937,323

[22] Filed: Aug. 28, 1978

[51] Int. Cl.[2] ..... A47L 11/38

[52] U.S. Cl. ..... 15/50 R; 15/DIG. 2

[58] Field of Search ..... 15/21 E, 49 R, 49 C, 15/50 R, 50 C, 98, 103, 53 A, 53 R, DIG. 2

[56] References Cited

U.S. PATENT DOCUMENTS

| | | | |
|---|---|---|---|
| 3,404,653 | 10/1968 | Sierra et al. | 15/49 R X |
| 3,439,372 | 4/1969 | Collier | 15/50 R X |
| 3,665,542 | 5/1972 | Franzreb | 15/98 |
| 3,680,164 | 8/1972 | Thornton-Trump | 15/49 C X |
| 3,922,745 | 12/1975 | Lehman | 15/49 R X |

FOREIGN PATENT DOCUMENTS

| | | | |
|---|---|---|---|
| 1951107 | 4/1971 | Fed. Rep. of Germany | 15/50 R |
| 2266768 | 10/1975 | France | 15/50 C |

*Primary Examiner*—Edward L. Roberts
*Attorney, Agent, or Firm*—Daniel Jay Tick

[57] ABSTRACT

A hydraulically controlled telescopic boom is mounted on a wheeled powered vehicle. A hydraulic system controls the length of the boom and its direction to the right and left of the vehicle. An electric motor is mounted on the boom at the free end thereof. A cleaning brush is coupled to and driven by the motor for rotatably brushing the surface of a wall. A chemical cleanser and water system are coupled to the brush to supply chemical cleanser and water to wash and rinse a wall via the brush.

1 Claim, 2 Drawing Figures

WALL CLEANING APPARATUS

BACKGROUND OF THE INVENTION

The present invention relates to a wall cleaning apparatus.

Wall cleaning devices of the type described herein are disclosed in the following United States patents. U.S. Pat. No. 3,099,852, issued Aug. 6, 1963 to Grant, U.S. Pat. No. 3,665,542, issued May 30, 1972 to Franzreb, U.S. Pat. No. 3,680,164, issued Aug. 1, 1972 to Thornton-Trump, U.S. Pat. No. 3,748,680, issued July 31, 1973 to Griffin, U.S. Pat. No. 3,772,725, issued Nov. 20, 1973 to Shelstad and U.S. Pat. No. 3,922,745, issued Dec. 2, 1975 to Lehman.

Objects of the invention are to provice wall cleaning apparatus of simple structure, which is inexpensive in manufacture, used with facility and convenience, and functions efficiently, effectively and reliably to clean a wall or a ceiling of any dimensions.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
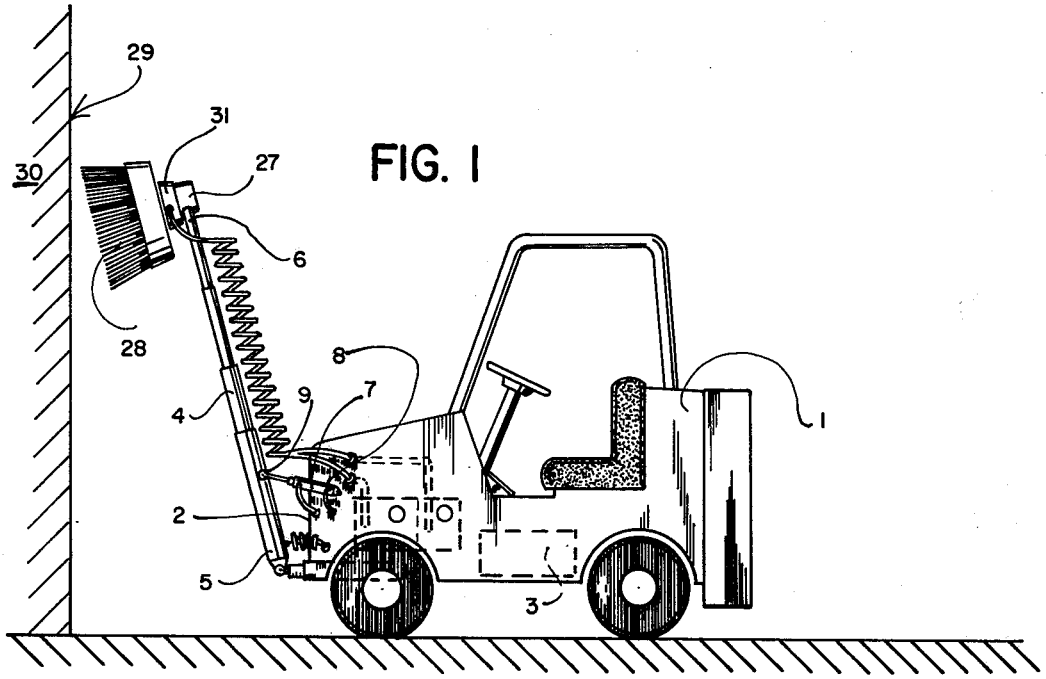
FIG. 1 is a view of an embodiment of the wall cleaning apparatus of the invention.

The wall cleaning apparatus of the invention comprises a wheeled, powered vehicle 1 of any suitable type such as, for example, an electrically powered vehicle, having a front 2, a left side 3 (FIG. 1) and a right side, not shown in the view of FIG. 1.

Figure 2:
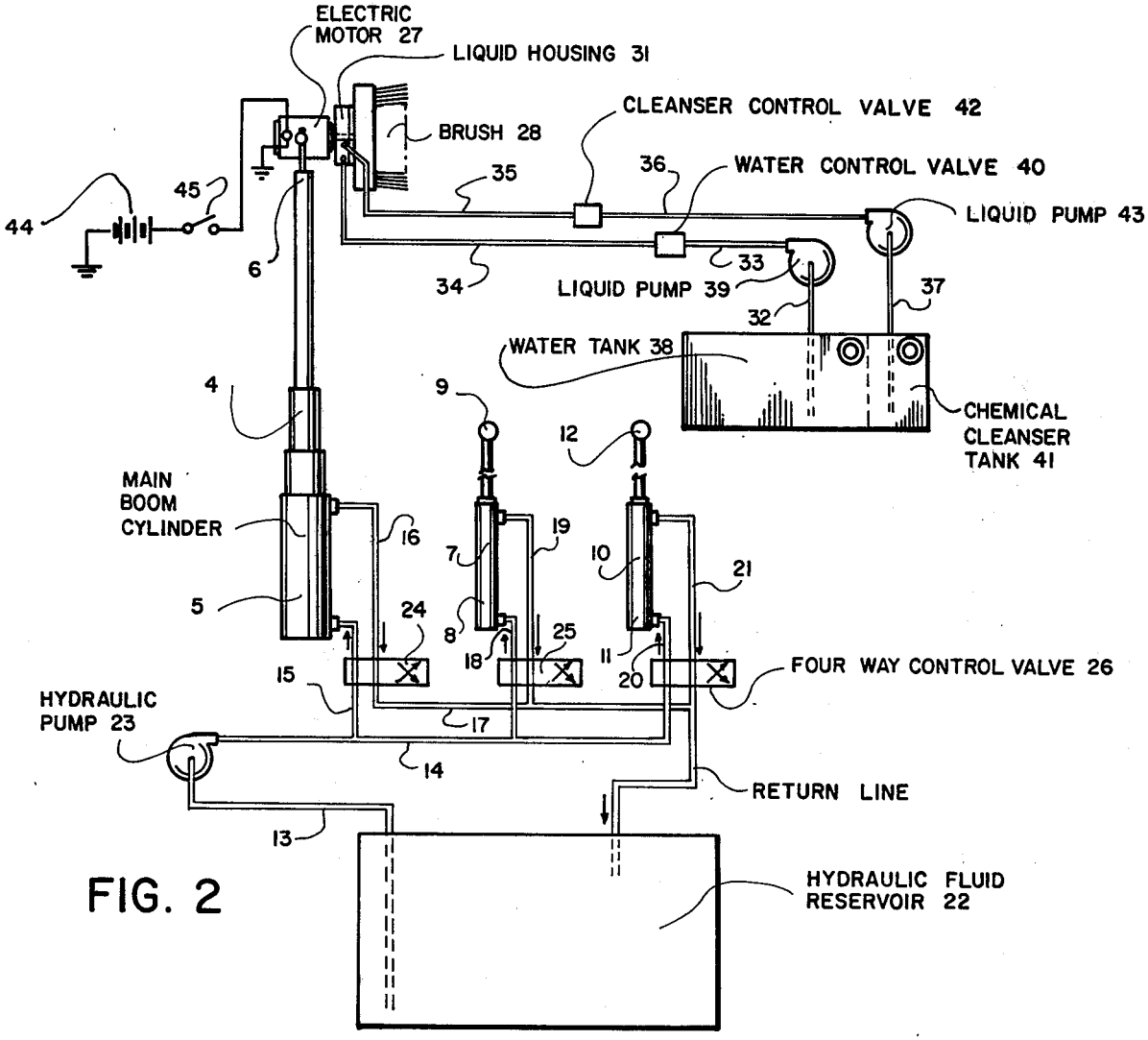
FIG. 2 is a schematic diagram of the wall cleaning apparatus of the invention.

A hydraulically controlled telescopic main boom 4 has spaced opposite first and second ends 5 and 6, respectively, as shown in FIGS. 1 and 2. The main boom 4 is mounted at its first end 5 on the front 2 of the vehicle 1 and is adjustable in length from said vehicle.

A pair of hydraulically controlled directional control cylinders and pistons are provided. As shown in FIGS. 1 and 2, a left directional control cylinder and piston has spaced opposite first and second ends 8 and 9. A right directional control cylinder and piston has spaced opposite first and second ends 11 and 12 (FIG. 2). The control cylinders are mounted at their first ends 8 and 11, respectively, on the left and right sides, respectively, of the vehicle 1 and the pistons are mounted at their second ends 9 and 12, respectively, to the main boom 4.

A hydraulic duct system 13, 14, 15, 16, 17, 18, 19, 20, 21 connects a hydraulic fluid reservoir 22 mounted on the vehicle 1, the main boom 4, the directional control cylinders and pistons 7 and 10, a hydraulic pump 23 in the vehicle and a plurality of four-way control valves 24, 25 and 26 in a hydraulic circuit, as shown in FIG. 2, in a manner whereby the length and direction of the main boom relative to the vehicle are controlled via said control valves. This is accomplished by adjusting the length of the main boom 4 via the four-way valve 24, adjusting the movement of the main boom to the left via the left side control cylinder and piston 7 and the four-way valve 5 thereof, and adjusting the movement of the main boom to the right via the right side control cylinder and piston 10 and the four-way valve 26.

An electric motor 27 is mounted on the main boom 4 at the second end 6 thereof. A cleaning brush 28 is coupled to, and driven by, the motor 27 for rotatably brushing the surface 29 of a wall 30 (FIG. 1).

A liquid housing 31 is mounted on the brush 28 (FIGS. 1 and 2).

A liquid duct system 32, 33, 34, 35, 36, 37 (FIG. 2) has one branch 32, 33, 34 connecting a water tank 38 on the vehicle, a liquid pump 39 in the vehicle and a water control valve 40 in a water circuit with the liquid housing 31, in a manner whereby water is supplied to the brush 28 under the control of said water control valve.

The liquid duct system has another branch 35, 36, 37 connecting a chemical cleanser tank 41 mounted on the vehicle, a cleanser control valve 42 and another liquid pump 43 in a chemical cleanser circuit with the liquid housing 31, as shown in FIG. 2, in a manner whereby chemical cleanser is supplied to the brush 28 under the control of said cleanser control valve.

The electric motor 27 is powered by a battery 44 mounted on the vehicle 1 and electrically connected to said motor via an ON-OFF switch 45 (FIG. 2).

The operator of the vehicle 1 first provides chemical cleanser from the chemical cleanser tank 41 to the brush 28 via the liquid housing 31 and rotates said brush via the electric motor 27 as he moves said brush in desired directions to cover the surface to be cleaned. The operator of the vehicle 1 then discontinues the supply of chemical cleanser and substitutes water from the water tank 38 in its stead. He then moves the rotating brush 28 over the surface to be cleaned thereby rinsing it, and thereby completing the job of washing such surface.

If it is desired to dry the cleaned surface, this may be accomplished by replacing the brush 28 with a wad of drying material, buffer, or the like, or by coupling the end of an air hose to the second end 6 of the main boom 4 and air-drying the surface.

While the invention has been described by means of a specific example and in a specific embodiment, I do not wish to be limited thereto, for obvious modifications will occur to those skilled in the art without departing from the spirit and scope of the invention.

I claim:

1. Wall cleaning apparatus, comprising a wheeled powered vehicle having a front and sides;

a hydraulically controlled telescopic main boom having spaced opposite first and second ends, said main boom being mounted at its first end on the vehicle and adjustable in length from the vehicle;

a pair of hydraulically controlled directional control cylinders and pistons each having spaced opposite first and second ends, each of said control cylinders being mounted at its first end on a corresponding side of the vehicle and affixed at its second end to the main boom;

a hydraulic pump in the vehicle;

a hydraulic fluid reservoir in the vehicle;

a plurality of control valves in the vehicle;

a hydraulic duct system connecting the hydraulic fluid reservoir, the main boom, the directional control cylinders and pistons, the hydraulic pump and the plurality of control valves in a hydraulic circuit in a manner whereby the length and direction of said main boom relative to the vehicle are controlled via said control valves;

an electric motor mounted on the main boom at the second end thereof;

a cleaning brush coupled to and driven by the motor for rotatably brushing the surface of a wall;

a liquid housing mounted on the brush;

a pair of liquid pumps;

a water tank having water therein;

a chemical cleanser tank having chemical cleanser therein;

a pair of liquid control valves; and a liquid duct system having one branch connecting the water tank, one of the liquid pumps and one of the liquid control valves in a water circuit with the liquid housing in a manner whereby water is supplied to the brush under the control of said one of said valves and another branch connecting the chemical cleanser tank, the other of the liquid pumps and the other of the liquid control valves in a chemical cleanser circuit with the liquid housing in a manner whereby chemical cleanser is supplied to the brush under the control of said other of said valves.

* * * * *